US005689151A

United States Patent [19]

Wallace et al.

[11] Patent Number: 5,689,151

[45] Date of Patent: Nov. 18, 1997

[54] ANODE PLATE FOR FLAT PANEL DISPLAY HAVING INTEGRATED GETTER

[75] Inventors: Robert M. Wallace; John M. Anthony, both of Richardson; Bruce E. Gnade, Dallas; Chih-Chen Cho, Richardson, all of Tex.

[73] Assignee: Texas Instruments Incorporated, Dallas, Tex.

[21] Appl. No.: 535,506

[22] Filed: Sep. 28, 1995

Related U.S. Application Data

[60] Provisional application No. 60/002,166, Aug. 11, 1995.

[51] Int. Cl. [6] ..... H01J 17/24

[52] U.S. Cl. ..... 313/495; 313/481; 313/553

[58] Field of Search ..... 313/481, 545, 313/546, 553, 561, 495; 445/55

[56] References Cited

U.S. PATENT DOCUMENTS 5,308,533 5/1994 Hotaling et al. ..... 445/55
5,453,659 9/1995 Wallace et al. ..... 313/495
5,470,802 11/1995 Gnade et al. ..... 437/238
5,491,376 2/1996 Levine et al. ..... 313/495
5,525,857 6/1996 Gnade etal. ..... 313/309
5,528,102 6/1996 Gnade et al. ..... 313/496

*Primary Examiner*—Sandra L. O'Shea
*Assistant Examiner*—Vip Patel
*Attorney, Agent, or Firm*—Christopher L. Maginniss; W. James Brady, III; Richard L. Donaldson

[57] ABSTRACT

An anode plate (10) for use in a field emission flat panel display device (8) comprises a transparent substrate (26) having a plurality of spaced-apart, electrically conductive regions (28) which form the anode electrode of the display device (8). The conductive regions (28) are covered by a luminescent material (24). A getter material (29) is deposited on the substrate (26) and between the conductive regions (28) of the anode plate (10). The getter material (29) is preferably an electrically nonconductive, high porosity, and low density material, such as an aerogel or xerogel. Methods of fabricating the getter material (29) on the anode plate (10) are disclosed.

14 Claims, 4 Drawing Sheets

ANODE PLATE FOR FLAT PANEL DISPLAY HAVING INTEGRATED GETTER

RELATED APPLICATIONS

This application claims priority under 35 U.S.C. §119(c)(1) of provisional application Ser. No. 60/002,166, filed 11 Aug. 1995.

This application is related to copending application Ser. No. 08/535,863, *Anode Plate for Flat Panel Display Having Integrated Getter*, filed 28 Sep. 1995; U.S. Pat. No. 5,525,857, *Low Density, High Porosity Material as Gate Dielectric for Field Emission Device*, issued 11 Jun. 1996; U.S. Pat. No. 5,491,376, *Flat Panel Display Anode Plate Having Isolation Grooves*, issued 13 Feb. 1996; U.S. Pat. No. 5,453,659, *Anode Plate for Flat Panel Display Having Integrated Getter*, issued 26 Sep. 1995; and U.S. Pat. No. 5,528,102, *Anode Plate With Opaque Insulating Material for Use in a Field Emission Display*, issued 18 Jun. 1996, all assigned to the same assignee as the present application.

TECHNICAL FIELD OF THE INVENTION

The present invention relates generally to flat panel displays and, more particularly, to a structure and method for providing improved gettering within a field emission flat panel display.

BACKGROUND OF THE INVENTION

The advent of portable computers has created demand for display devices which are lightweight, compact, and power efficient. Since the space available for the display of these devices precludes the use of a conventional cathode ray tube (CRT), there has been an effort to produce flat panel displays having comparable or even superior display characteristics.

Liquid crystal displays are commonly used for laptop and notebook computers. These displays may suffer from poor contrast, a limited range of viewing angles, and power requirements which are incompatible with extended battery operation. In addition, color liquid crystal displays tend to be far more costly than CRTs of equal screen size.

As a result of these limitations of liquid crystal display technology, field emission display technology has received more attention in the industry. Field emission flat panel displays employ a matrix-addressable array of field emission cathodes in combination with an anode comprising a luminescent screen. The manufacture of inexpensive, low-power, high-resolution, high-contrast, full-color flat panel displays using this technology appears promising.

In order for field emission displays to operate efficiently, it is desirable to maintain a vacuum within the cavity of the display, typically less than $10^{-6}$ Torr. The cavity is pumped out and degassed before assembly, but over time the pressure in the display builds up due to outgassing of the components inside the display and to the finite leak rate of the atmosphere into the cavity. Getters are employed as pumps that adsorb these undesirable gases in order to maintain a minimum pressure in the cavity.

In field emission flat panel displays, the cathode or emitter plate and the anode plate may be spaced from one another at a relatively small distance. This spacing, typically on the order of two hundred microns, limits the total volume of the cavity enclosed within the display screen. Due to the limited volume within the cavity, the getter is normally placed in peripheral regions, such as in the pump-out tubulation at the back of the display. The placement of the getter material outside of the active region of the display in combination with the small volume within the cavity severely reduces the pumping effectiveness of the getter.

SUMMARY OF THE INVENTION

In accordance with the present invention, the disadvantages and problems associated with the use of a getter to maintain a vacuum within a field emission flat panel display have been substantially reduced or eliminated.

In accordance with one embodiment of the present invention, an anode plate for use in a display device comprises a substantially transparent substrate. A plurality of spaced-apart, electrically conductive regions are located on the substrate. A luminescent material is adjacent to the conductive regions. Getter material is disposed on the substrate and between the conductive regions.

In accordance with another aspect of the present invention, a method for fabricating an anode plate for use in a display device comprises the steps of providing a substantially transparent substrate, forming a plurality of spaced-apart, electrically conductive regions on the substrate, forming a getter material on the substrate and between the conductive regions, and forming a luminescent material on the conductive regions.

Important technical advantages of the present invention include maintaining the vacuum integrity of a field emission flat panel display over the life of the display. This is accomplished by placing the getter material in close proximity to the display elements which are subject to outgassing and to those elements of the display which are adversely effected by increases in gas pressure. In particular, a getter material is deposited on the substrate and between the conductive regions of the anode plate. This placement substantially increases the pumping effectiveness of the getter material over other systems that place getters in the periphery of the display.

Other important technical advantages of the present invention include providing an electrically nonconductive getter which can be deposited within the cavity of the display. In the preferred embodiment, this getter material comprises aerogels and xerogels. Aerogels and xerogels are low density, high porosity materials with a surface that can be activated at a low temperature through drying. Furthermore, aerogels and xerogels can be deposited to provide a voltage standoff between conductive regions on the anode plate.

BRIEF DESCRIPTION OF THE DRAWINGS

For a more complete understanding of the present invention, and for further features and advantages, reference is now made to the following description taken in conjunction with the accompanying drawings, in which.

DETAILED DESCRIPTION OF THE INVENTION

Figure 1:
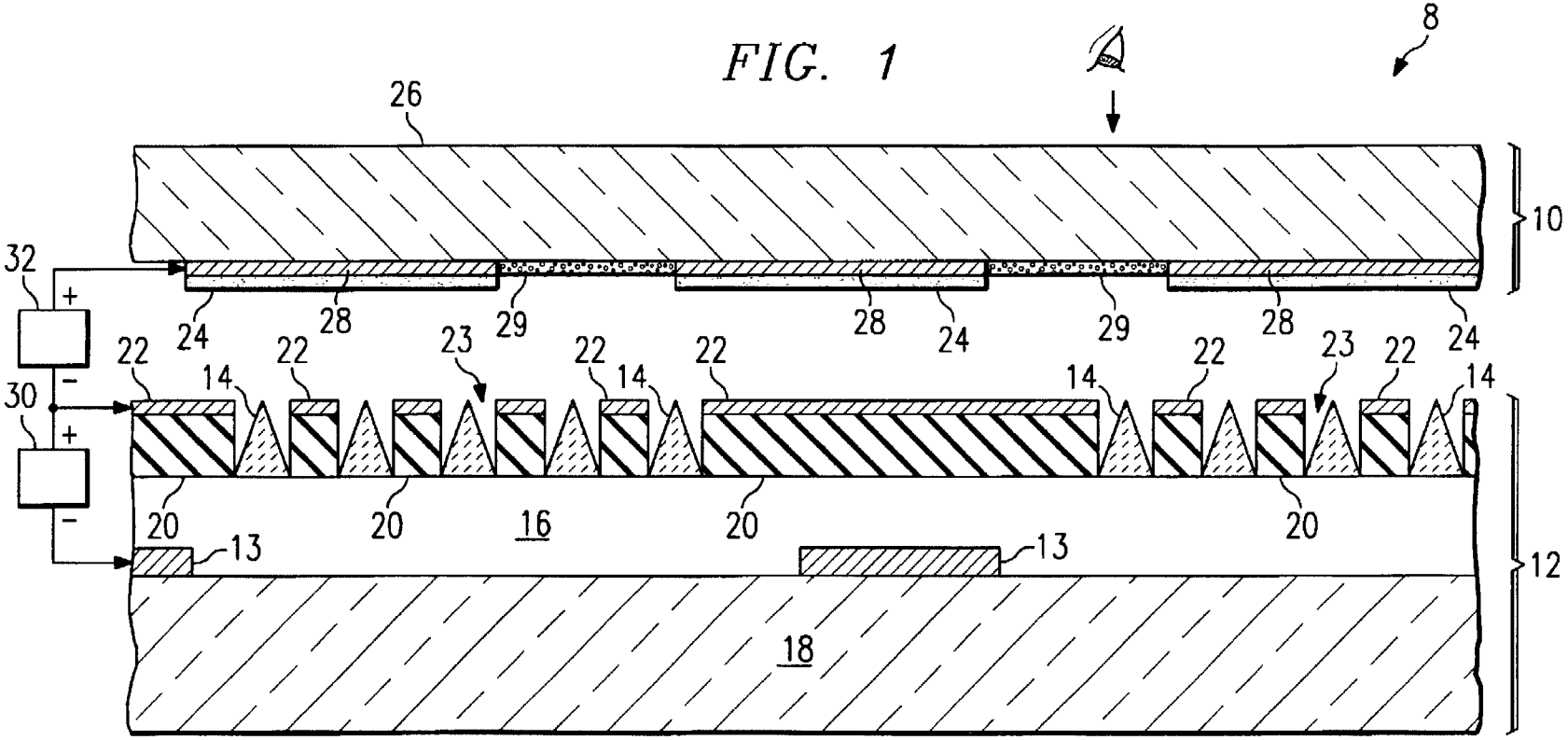
FIG. 1 illustrates in cross section a portion of a field emission flat panel display device.

FIG. 1 illustrates, in cross-section, a display device 8 which comprises an anode plate 10 and an emitter (or cathode) plate 12. The cathode portion of emitter plate 12 includes conductors 13 formed on an insulating substrate 18, a resistive layer 16 also formed on substrate 18 and overlying conductors 13, and a plurality of electrically conductive emitters 14 formed on resistive layer 16. When viewed from above, conductors 13 comprise a mesh structure, and emitters 14 are configured as a matrix within the mesh spacings.

In one embodiment, display device 8 may be a field emission display device that benefits from removal of all ambient species between anode plate 10 and emitter plate 12. Display device 8 may also be a plasma display, in which the space between anode plate 10 and emitter plate 12 contains a plasma. A getter material for a plasma display may be chosen to react with undesirable species without substantially degrading the plasma.

Gate electrode 22 comprises a layer of an electrically conductive material deposited on an insulating layer 20 which overlies resistive layer 16. Emitters 14 are in the shape of cones which are formed within apertures 23 through gate electrode 22 and insulating layer 20. The thickness of the conductive layer forming gate electrode 22 and the thickness of insulating layer 20 are chosen in conjunction with the size of apertures 23 so that the apex of each emitter 14 is substantially level with gate electrode 22. Gate electrode 22 is arranged as rows of conductive bands across the surface of substrate 18, and the mesh structure of conductors 13 is arranged as columns of conductive bands across the surface of substrate 18. Emitters 14 are activated by energizing a row of gate electrode 22 and a column of conductors 13, which correspond to a pixel of display device 8.

Figure 2A:
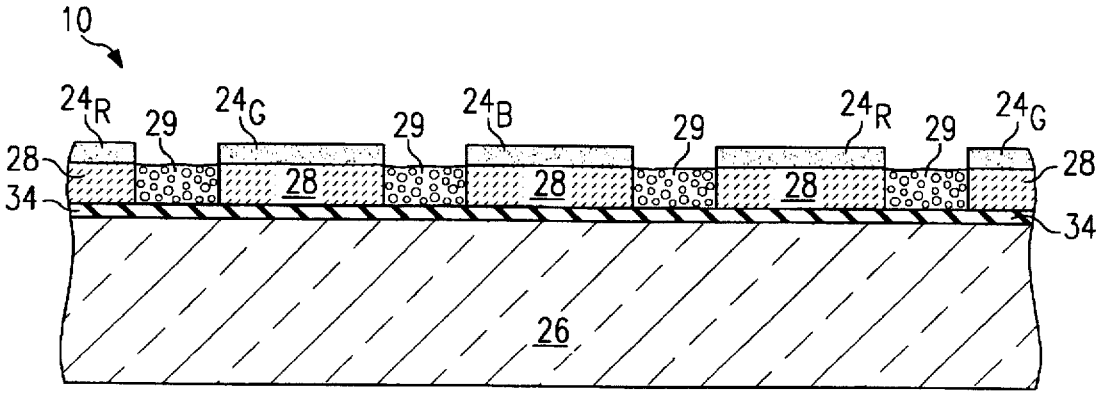
FIG. 2A illustrates in cross section a portion of an anode plate of a field emission flat panel display device corresponding to a first embodiment of the present invention.
Figure 2B:
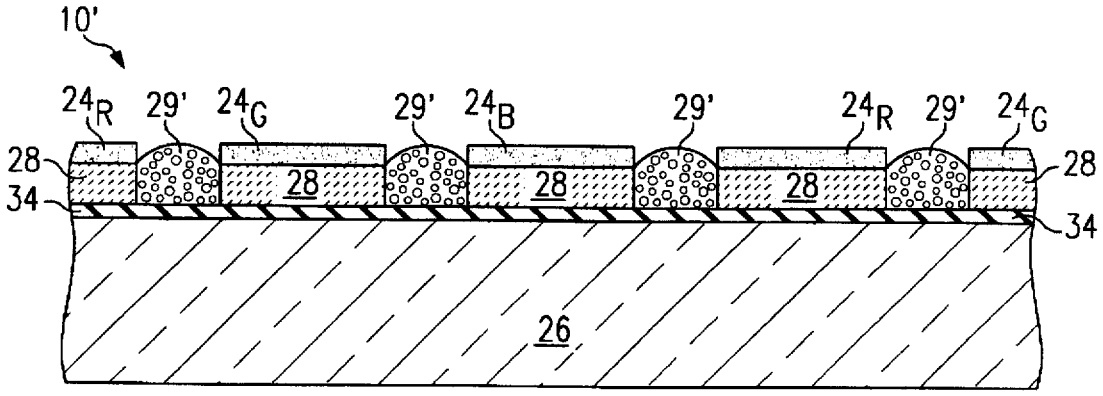
FIG. 2B illustrates in cross section a portion of an anode plate of a field emission flat panel display device corresponding to a second embodiment of the present invention.

Anode plate 10 comprises a substantially transparent substrate 26 with a plurality of electrically conductive regions 28 formed on substrate 26. In one embodiment, conductive regions 28 are spaced-apart to form parallel stripes on anode plate 10. Conductive regions 28 may also be continuous, such as the structure found in a cathode ray tube (CRT). Conductive regions 28 are formed on the surface of substrate 26, or on an optional thin insulating layer of silicon dioxide ($SiO_2$) 34 (FIGS. 2A and 2B). In display device 8, conductive regions 28 of anode plate 10 are positioned opposite gate electrode 22 of emitter plate 12.

In this example, conductive regions 28, which comprise the anode electrode, are in the form of electrically isolated stripes forming parallel conductive bands across the surface of substrate 26. Luminescent material 24 is formed over conductive regions 28 so as to be directly facing and immediately adjacent gate electrode 22. No true scaling information is intended to be conveyed by the relative sizes and positioning of the elements of anode plate 10 and the elements of emitter plate 12 as depicted in FIG. 1.

Getter material 29 is disposed on substrate 26 and between conductive regions 28. Getter material 29, when activated and sealed in display device 8, acts as a pump to adsorb undesirable elements caused by outgassing of surfaces and films inside display device 8 and finite leak rates from the outside atmosphere.

The placement of getter material 29 on anode plate 10 provides several advantages. Getter material 29 is placed in close proximity to those components of display device 8 which are subject to outgassing, such as luminescent material 24 and gate electrode 22, and in close proximity to those components of display device 8 which are adversely affected by increases in gas pressure, such as emitters 14. This placement substantially increases the pumping effectiveness of the getter material from approximately one milliliter per second when getters are placed in the periphery of the display to as much as 1,000 liters per second. Furthermore, by virtue of its electrical insulating quality, getter material 29 increases the electrical isolation between conductive regions 28, which permits higher anode potentials without the risk of breakdown due to increased leakage current.

Emitters 14 are activated by applying a negative potential to conductors 13, functioning as the cathode electrode relative to the gate electrode 22, via voltage supply 30. The induced electric field draws electrons from the apexes of emitters 14. The emitted electrons are accelerated towards anode plate 10, which is positively biased by the application of a larger positive voltage from voltage supply 32 coupled between gate electrode 22 and conductive regions 28 functioning as the anode electrode. Energy from the electrons attracted to conductive regions 28 is transferred to luminescent material 24, resulting in luminescence. The luminescence is observed through conductive regions 28 and substrate 26. The electron charge is transferred from luminescent material 24 to conductive regions 28, completing the electrical circuit to voltage supply 32.

FIG. 2A illustrates, in cross-section, an anode plate 10 for use in display device 8 fabricated using the process steps described below with reference to FIGS. 3A through 3G. Anode plate 10 comprises a transparent substrate 26, which may include a thin layer 34 of an insulating material, such as silicon dioxide ($SiO_2$). A plurality of spaced-apart, electrically conductive regions 28 are patterned on insulating layer 34. Conductive regions 28 collectively comprise the anode electrode of display device 8. Luminescent material $24_R$, $24_G$, and $24_B$, referred to collectively as luminescent material 24, is positioned adjacent to conductive regions 28. Getter material 29 is disposed on substrate 26 and between conductive regions 28.

In the present example, substrate 26 preferably comprises glass. For the case where ultraviolet emission is important, substrate 26 may comprise quartz. Also in this example, conductive regions 28 comprise a plurality of parallel stripe conductors which extend normal to the plane of the drawing sheet. A suitable material for conductive regions 28 may be indium tin oxide (ITO), which is sufficiently optically transparent and electrically conductive. By way of illustration, parallel stripes of conductive regions 28 may be eighty microns in width, and spaced from one another by thirty microns. In this example, luminescent material 24 comprises a particulate phosphor coating which luminesces in one of the three primary colors, red ($24_R$), green ($24_G$), and blue ($24_B$). Luminescent material 24 may also comprise a thin-film phosphorescent material or any other suitable material that luminesces when subjected to electron bombardment or impingement. The thickness of conductive regions 28 may be approximately one hundred and fifty nanometers, and the thickness of luminescent material 24 may be approximately fifteen microns. Luminescent material 24 may be applied to conductive regions 28 using electrophoretic deposition.

A getter, such as getter material 29, has surfaces that can be rendered chemically active so as to promote the adsorption of ambient species. To be highly effective, the getter should have a high surface area to volume ratio. Also the getter should be chosen to specifically react with substances which degrade performance of display device 8, such as water vapor, organic molecules, and various gases. The getter can be rendered active by annealing in a relatively inert ambient, such as a high vacuum or an inert gas environment, and maintained in the ambient during the sealing of display device 8. Examples of conventional metallic getters include evaporable (Ti or Ba) and non-evaporable (Zr-V-Fe, Zr-Al, Zr-Fe, Zr-Ni) types available from SAES Getters of Milan, Italy. Alternatively, non-metallic getters, such as zeolites, are also available.

The present invention utilizes a new type of non-metallic getter based on porous, high surface area, silica aerogels and xerogels. In general, a silica gel is a colloidal system of solid character in which silica ($SiO_2$) is dispersed to form a continuous, coherent framework which is interpenetrated by liquid, such as water. Silica aerogels are produced by the removal of liquid from the silica gel using supercritical or hypercritical fluid methods. A silica xerogel, in contrast, is produced by simple evaporation of liquid.

Both aerogels and xerogels are low density, high porosity materials. In the case of aerogels, the drying methods employed result in very little shrinkage and produce a dry network of solid containing large amounts of air within the structure. Aerogels have higher surface areas, lower densities, larger pore sizes, and greater pore volumes than xerogels. An active metal species, such as the conventional metallic getters described above, may be incorporated into the aerogel/xerogel framework to offer enhanced chemical activity and improved pumping action of the getter. Carbon doping may be used to render the aerogel/xerogel opaque, which may improve picture contrast of display device 8. The present invention contemplates the use of aerogels, xerogels, or both as getter material 29. Getter material 29 is preferably formed from a solution of tetraethoxysilane (TEOS), which is sold by, for example, Allied Signal Corp., of Morristown, N.J. The solution of TEOS, including a solvent which may comprise ethyl alcohol, acetone, N-butyl alcohol, and water, is commonly referred to as "spin-on-glass" (SOG). The TEOS and solvents are combined in proportions according to the desired viscosity of the SOG solution. TEOS provides the advantages that it cures at a relatively low temperature, approximately 100° C., which is compatible with substrate 26 formed from soda lime glass with a softening point of 490° C. When fully cured, most of the solvent and most of the organic materials in the TEOS are driven out, leaving primarily glass ($SiO_x$). The TEOS solution may be spun on the surface of anode plate 10, or it may be spread on the surface, using techniques which are well known in the manufacture of, for example, liquid crystal display devices.

Referring now to FIG. 2B, there is shown a cross-sectional view of anode plate 10' for use in a display device 8 fabricated using the process steps described below with reference to FIGS. 4A through 4F. In the remaining discussion, elements which are identical to those already described are given identical numerical designators, and those elements which are similar in structure and which perform identical functions to those already described are given the primed numerical designators of their counterparts. In this embodiment, getter material 29' is deposited using a negative photoresist and liftoff process, which results in getter material 29' extending above the plane formed by conductive regions 28.

The surface area available for getter material 29 and 29' deposited on anode plate 10 and 10', respectively, is significantly greater than other previous getter structures. In the embodiment of FIG. 2A, where the interstitial width between conductive regions 28 is thirty microns, the area for depositing getter material 29 for a color display having 640 lines, each of three colors and approximately six inches in length, is almost fourteen square inches compared with about two square inches of getter surface in a typical display device. In the embodiment of FIG. 2B, the area for depositing getter material 29' may be even greater.

Figure 3A:
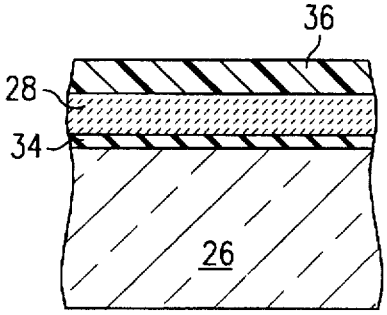
FIGS. 3A through 3G illustrate steps for fabricating the anode plate of FIG. 2A.

FIGS. 3A through 3G illustrate process steps for fabricating anode plate 10 of FIG. 2A. Referring to FIG. 3A, a glass substrate 26 is coated with an insulating layer 34, typically $SiO_2$, which may be sputter deposited to a thickness of approximately fifty nanometers. A transparent, electrically conductive layer 28, typically indium tin oxide (ITO), is deposited on insulating layer 34, for example by sputtering to a thickness of approximately one hundred and fifty nanometers. A photoresist layer 36, such as type AZ-1350J sold by Hoecht-Celanese of Sommerville, N.J., is coated over conductive layer 28 to a thickness of approximately one thousand nanometers.

Figure 3B:
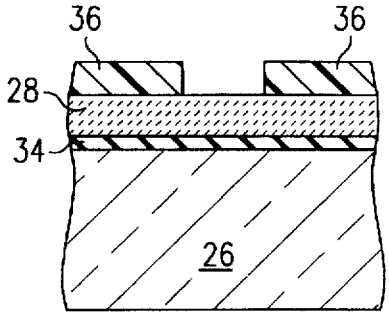
Figure 3C:
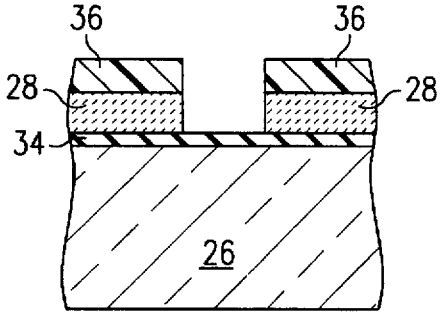

A patterned mask is disposed over photoresist layer 36 exposing regions of the photoresist. In the case of this illustrative positive photoresist, the exposed regions are removed during the development step, which may comprise soaking the assembly in Hoecht-Celanese AZ-developer. The developer removes unwanted photoresist, leaving photoresist layer 36 patterned as shown in FIG. 3B. The exposed regions of conductive layer 28 are then removed, typically by a wet etch process, using for example an etchant solution of 6M hydrochloric acid (HCl) and 0.3M ferric chloride ($FeCl_3$), leaving a structure as shown in FIG. 3C. Although not shown as a part of this process, it may also be desirable to remove insulating layer 34 underlying the etched-away regions of the conductive layer 28.

Figure 3D:
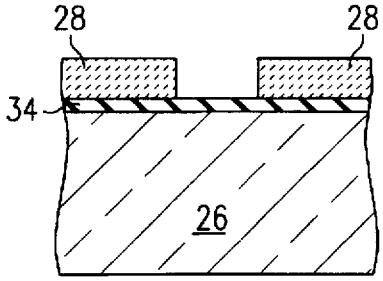

The patterning, developing, and etching processes leave regions of conductive layer 28 which form substantially parallel stripes across the surface of anode plate 10. The remaining photoresist layer 36 may be removed by a wet etch process using an appropriate etchant, such as acetone. Alternatively, photoresist layer 36 may be removed using a dry, oxygen plasma ash process. FIG. 3D illustrates the anode structure having patterned conductive layer 28 at the current stage of the fabrication process.

A precursor to the aerogel/xerogel getter is prepared by mixing tetraethoxysilane (TEOS) stock, ethanol, water, and hydrochloric acid (HCl) in an approximate molar ratio of 1:3:1:0.0007, under constant reflux at 60° C. for 1.5 hours. Next, a 0.5M ammonium hydroxide solution is added to the precursor at about 0.1 milliliters for each milliliter of TEOS stock to initiate the gelling process.

Figure 3E:
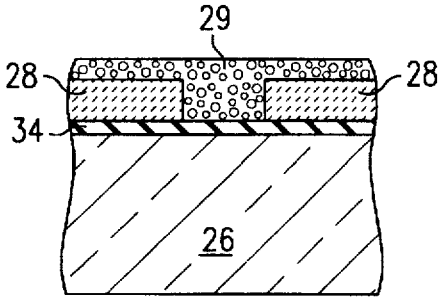

A coating 29 of the aerogel/xerogel precursor is applied over patterned conductive layer 28 and insulating layer 34, typically to an average thickness of approximately one thousand nanometers above the surface of insulating layer 34. The method of application may comprise dispensing the aerogel/xerogel precursor onto the assembly while spinning substrate 26, thereby dispersing coating 29 relatively uniformly over the surface, as shown in FIG. 3E. The assembly may be immersed in liquid or in a saturated atmosphere prior to the drying stage to ensure that coating 29 does not dry prematurely. Coating 29 may be gelled, a process which takes from one minute to twelve hours, depending on the solution and the method of gelling. Aging of coating 29 may be accomplished by immersion of the assembly in a saturated ethanol atmosphere for approximately twenty-four hours at about 37° C. This aging time can be reduced by increasing the temperature during the aging process.

The drying process for coating 29 involves evaporation of pore fluid to form aerogel/xerogel layer 29. Precursor coating 29 and aerogel/xerogel layer 29 are referred to with the same reference numeral, since their positions are substantially coextensive in the structure of anode plate 10. Many techniques for drying wet gels are discussed in U.S. Pat. No. 5,470,802, *Method of Making a Semiconductor Device*

*Using a Low Dielectric Constant Material,* issued 28 Nov. 1995. This patent also discloses other materials and processing parameters which can be used to produce aerogel/xerogel layer 29. One method of drying removes the solvent from a wet gel under supercritical pressure and temperature conditions. By removing the solvent under supercritical conditions, the liquid solvent does not vaporize. Instead, the fluid undergoes a constant change in density from a compressed liquid to a superheated vapor with no distinguishable state boundary.

Figure 3F:
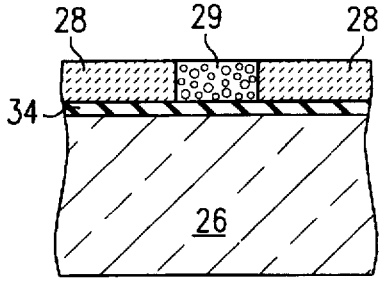
Figure 3G:
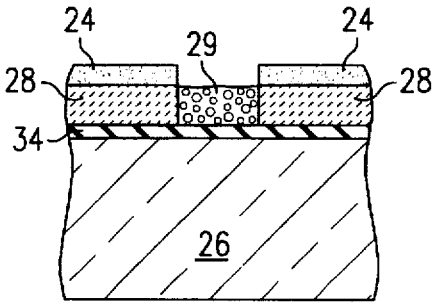

Aerogel/xerogel layer 29 is then etched, for example by an oxide plasma etch process, until conductive layer 28 is exposed, as shown in FIG. 3F. Particulate phosphor coating 24 is deposited on conductive layer 28, typically by electrophoretic deposition, which results in the structure shown in FIG. 3G.

Anode plate 10 is then annealed to approximately 100° C. in an inert environment, such as a high vacuum or an inert gas, in order to desorb contaminants, such as water, from the aerogel/xerogel getter surfaces. This process activates aerogel/xerogel layer 29 and outgasses phosphor coating 24.

FIGS. 4A through 4F illustrate process steps for fabricating anode plate 10' of FIG. 2B. Now referring to FIG. 4A, a glass substrate 26 is coated with an insulating layer 34, typically $SiO_2$, which may be sputter deposited to a thickness of approximately fifty nanometers. A transparent, electrically conductive layer 28, typically indium tin oxide (ITO), is deposited on insulating layer 34, for example by sputtering to a thickness of approximately one hundred and fifty nanometers. A photoresist layer 36', such as SC-100 negative photoresist sold by OGC Microelectronic Materials, Inc. of West Patterson, N.J., is coated over conductive layer 28, to a thickness of approximately one thousand nanometers.

Figure 4A:
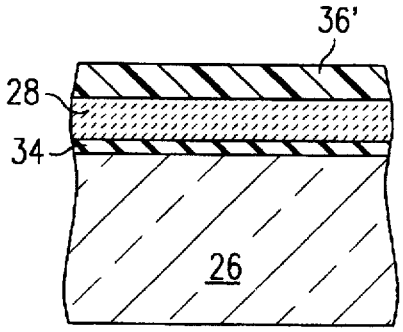
FIGS. 4A through 4F illustrate steps for fabricating the anode plate of FIG. 2B.
Figure 4B:
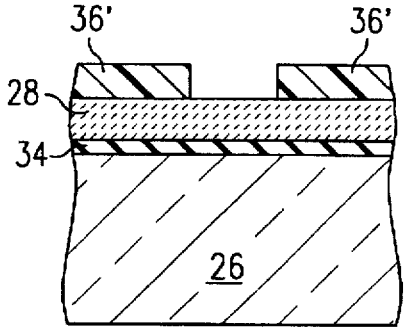
Figure 4C:
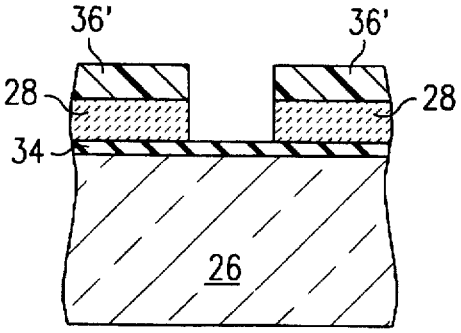

A pattern mask is disposed over photoresist layer 36' exposing regions of the photoresist. In the case of this illustrative negative photoresist, the exposed regions are to remain after the development step, which may comprise spraying the assembly first with Stoddard etch and then with butyl acetate. The unexposed regions of photoresist are removed during the developing process, leaving photoresist layer 36' patterned as shown in FIG. 4B. The exposed regions of conductive layer 28 are then removed, typically by a wet etch process, using for example an etchant solution of 6 M hydrochloric acid (HC1) and 0.3M ferric chloride ($FeCl_3$), leaving a structure as shown in FIG. 4C. It may also be desirable to remove insulating layer 34 underlying the etched-away regions of conductive layer 28.

Figure 4D:
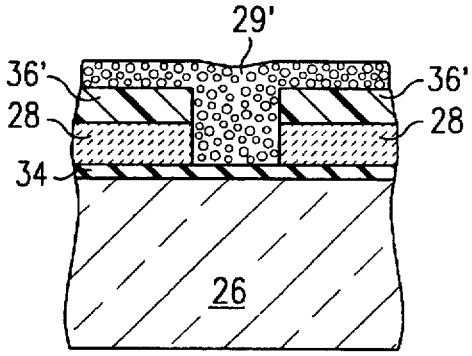
Figure 4E:
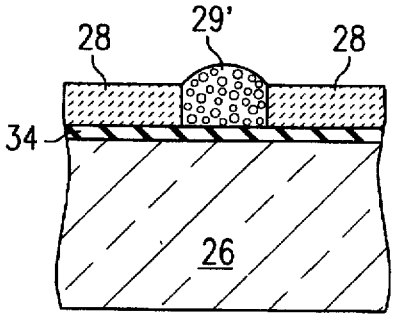

The patterning, developing, and etching processes leave regions of conductive layer 28 which form substantially parallel stripes across the surface of anode plate 10'. In this second embodiment, the remaining photoresist layer 36' is retained and the aerogel/xerogel precursor coating 29' is applied over photoresist layer 36' and the exposed regions of insulating layer 34, as shown in FIG. 4D.

Coating 29' is dried to form aerogel/xerogel layer 29', as described above with reference to fabrication of anode plate 10. Photoresist layer 36' is removed, bringing with it the overlying portions of aerogel/xerogel layer 29'. This liftoff process is a common semiconductor fabrication process. Hot xylene and a solvent comprising perchloroethylene, orthodichlorobenzene, phenol and alkylaryl sulfonic acid, may be sprayed on the assembly in sequence, to remove photoresist layer 36' resulting in the structure shown in FIG. 4E.

Figure 4F:
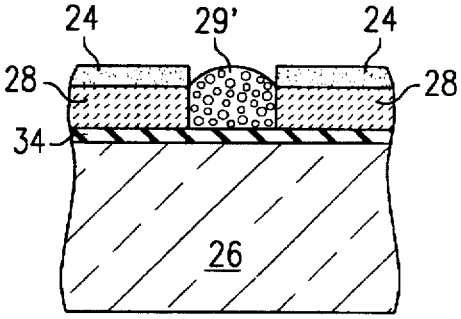

Phosphor coating 24 is deposited on conductive layer 28, typically by electrophoretic deposition, which results in the structure shown in FIG. 4F. Anode plate 10' is then annealed as described above with reference to anode plate 10. It should be appreciated that the process described in FIGS. 4A through 4F may entail fewer mask steps than that of FIGS. 3A through 3G.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the scope of the appended claims.

What is claimed is:

1. An anode plate for use in a display device, comprising:

a substantially transparent substrate;

a plurality of spaced-apart, electrically conductive regions on the substrate;

a luminescent material adjacent to the conductive regions; and means for adsorbing gases comprising getter material disposed on the substrate and between the conductive regions, said getter material comprising an electrically nonconductive, high porosity and low density material.

2. The anode plate of claim 1, wherein the substrate comprises an insulating layer adjacent to a glass substrate.

3. The anode plate of claim 1, wherein the spaced-apart, electrically conductive regions comprise substantially parallel stripes.

4. The anode plate of claim 1, wherein the spaced-apart, electrically conductive regions are formed of indium tin oxide.

5. The anode plate of claim 1, wherein the luminescent material comprises a particulate phosphorescent material.

6. The anode plate of claim 1, wherein the getter material is electrically nonconductive.

7. The anode plate of claim 1, wherein the getter material is selected from the group comprising aerogels and xerogels.

8. A field emission device, comprising:

an emitter plate operable to emit electrons; and an anode plate having a substantially planar face opposing the emitter plate, the anode plate comprising:

a substantially transparent substrate;

a plurality of spaced-apart, electrically conductive regions on the substrate;

a luminescent material adjacent to the conductive regions; and means for adsorbing gases comprising getter material disposed on the substrate and between the conductive regions, said getter material comprising an electrically nonconductive, high porosity and low density material.

9. The device of claim 8, wherein the substrate comprises an insulating layer adjacent to a glass substrate.

10. The device of claim 8, wherein the spaced-apart, electrically conductive regions comprise substantially parallel stripes.

11. The device of claim 8, wherein the spaced-apart, electrically conductive regions are formed of indium tin oxide.

12. The device of claim 8, wherein the luminescent material comprises a particulate phosphorescent material.

13. The device of claim 8, wherein the getter material is electrically nonconductive.

14. The device of claim 8, wherein the getter material is selected from the group comprising silica aerogels and silica xerogels.

* * * * *